US007007641B1

(12) United States Patent
Kryglowski et al.

(10) Patent No.: US 7,007,641 B1
(45) Date of Patent: Mar. 7, 2006

(54) ELECTRO-HYDRAULIC ASSEMBLY FOR CONTROLLING ENGINE VALVE DEACTIVATION

(75) Inventors: Nathan W. Kryglowski, Clawson, MI (US); Kenneth J. Parker, Lake Orion, MI (US); Charles Chang, Rochester Hills, MI (US); Tae-Kyung Kim, Sterling Heights, MI (US); Kelly M. Newby, Eastpoint, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/022,421

(22) Filed: Dec. 22, 2004

(51) Int. Cl.
*F01L 9/04* (2006.01)

(52) U.S. Cl. ..... 123/90.11; 123/90.15; 123/90.38; 123/193.3; 123/195 A; 123/198 F; 123/90.37; 248/226.11; 248/227.3; 29/888.3

(58) Field of Classification Search ..... 123/90.11, 123/90.38, 198 F; 248/226.11, 227.3
See application file for complete search history.

(56) References Cited

U.S. PATENT DOCUMENTS

| | | | | |
|---|---|---|---|---|
| 6,439,176 | B1 * | 8/2002 | Payne et al. | 123/90.12 |
| 6,481,409 | B1 * | 11/2002 | Wade et al. | 123/198 F |
| 6,591,796 | B1 * | 7/2003 | Scott | 123/90.13 |
| 6,644,265 | B1 | 11/2003 | Parker et al. | |
| 6,817,325 | B1 * | 11/2004 | Dinkel et al. | 123/90.13 |
| 6,904,895 | B1 * | 6/2005 | Moreno | 123/470 |

* cited by examiner

*Primary Examiner*—Thomas Denion
*Assistant Examiner*—Kyle M. Riddle
(74) *Attorney, Agent, or Firm*—Anna M. Shih; Roger A. Johnston

(57) ABSTRACT

A Lifter Oil Manifold Assembly or LOMA has a metal deckplate with a non-metallic valve mount/stiffener having elastomeric seals on the surface contacting the deckplate. The electrically operated valves for controlling flow to individual valve lifters are mounted on bosses formed on the valve mount/stiffener. A bracket retains the valves on the valve mount/stiffener and the valve mount/stiffener on the deckplate when assembled on the engine by through bolts.

16 Claims, 3 Drawing Sheets

ELECTRO-HYDRAULIC ASSEMBLY FOR CONTROLLING ENGINE VALVE DEACTIVATION

BACKGROUND OF THE INVENTION

The present invention relates to devices for controlling flow of hydraulic fluid such as engine lubricant to the valve lifters or lash adjusters in a multi-cylinder internal combustion engine. Devices of this type may be employed for deactivating combustion chamber valves of selected cylinders in the engine during light load operation for the purposes of minimizing engine fuel consumption.

In engines having an air throttle, it has been found that air flow restriction or throttling losses during light load operation with the throttle nearly closed increase the rate of fuel consumption; whereas, operation of the engine at near fully open throttle minimize the air throttling losses and improves the fuel economy of the engine. Accordingly, it has been desired to operate the throttled engine under conditions in which the throttle is opened a greater amount for given engine load conditions. This may be accomplished by deactivating the combustion chamber valves of selected cylinders and running the engine on fewer cylinders, therefore requiring greater throttle opening to maintain the engine power while operating on the fewer cylinders. Thus, it has been desired to employ engine cylinder deactivation to improve the fuel economy of large multi-cylinder engines and yet provide the desired power output of the engine when operating with all cylinders firing.

Heretofore, the technique most commonly employed for selectively deactivating the combustion chamber valves has utilized electrically operated valves for controlling the flow of engine lubricant to the lash adjusters or lifters of the valves for the cylinders selected for deactivation. In particular, the electrically operated valves have been mounted on a gasket secured to a deckplate having a supply channel providing pressurized engine lubricant to each of the valves; and, each valve is mounted on the gasket to control flow to selected outlet ports in communication with the individual lash adjuster/valve lifter control ports provided on the deckplate.

Such electro-hydraulic assemblies have been known as Lifter Oil Manifold Assemblies (LOMA) in the art of engine combustion chamber valve deactivation for multi-cylinder engines, particularly those employed having a V-type configuration for use in passenger cars and light trucks.

The assembly of the valves and the gasket has been retained on the deckplate by a superimposed rigid metal plate for stiffening the gasket assembly, with a mounting bracket superimposed thereover and which retains the valves in position in the valving chambers. The assembly may then be attached to the engine block by through bolts for mounting the deckplate over the appropriate lash adjuster/lifter galleries on the engine.

One example of a known system for the aforesaid type electro-hydraulic manifold assembly for cylinder combustion chamber valve deactivation is that shown and described in U.S. Pat. No. 6,644,265.

Referring to FIGS. 2 and 4, another known configuration of a LOMA is illustrated wherein the deckplate 1 has a supply channel 2 formed therein on one side or face and a plurality of individual output channels 3, 4, 5, 6 spaced thereon for communicating with lifter oil gallery ports (not shown) on one cylinder bank of a V-8 engine. The deckplate 2 is typically formed of metal such as aluminum. It will be understood that the assembly is illustrated in the inverted position in FIG. 4, with respect to the installed position on an engine.

A gasket assembly 7 has a flexible elastomeric seal bead 8 provided on the upper surface; and a corresponding flexible seal (not shown) provided on the undersurface for sealing against the deckplate 1. Gasket 7 has a plurality of valve mounting bosses 9, 10, 11, 12 extending upwardly therefrom and formed integrally with gasket 7. The bosses 9 through 12 each include an inlet port (not shown) which communicates with the supply channel 2 and an outlet port (not shown) which communicates respectively with one of the channels 3, 4, 5, 6 on the deckplate; and, accordingly the valve bosses 9–12 are located on the gasket 7 so as to have the outlet of each boss communicate respectively with one of the channels 3–6. A rigid stiffening plate commonly formed of metal denoted by reference numeral 13 is received over the gasket for insuring sealing, the gasket over the deckplate and for resisting deflection or bending and the attendant leakage caused by the forces of the pressurized oil in the channels.

Electrically operated valves 14, 15, 16, 17 are provided; and, each is received respectively in one of the bosses 9–12 with the inlet of the valve communicating with the inlet in the boss and the outlet of the valve communicating with the outlet port in the boss respectively. A retaining bracket 18 is received over the valves and plate 13 and is secured thereon by through bolts (not shown) for attachment to the engine cylinder block. Bracket 19 has a pair of lugs 20 provided thereon respectively for each of the valves 14–17 to retain the valve on the boss. A common electrical lead frame indicated generally at 21 is received over the valves to make electrical connection therewith.

The assemblies of the prior art thus have been complex and comprised of a multiplicity of pieces including a separate stiffening plate requiring individual fabricating operations and which have added weight and have been relatively costly for high volume motor vehicle engine production. Accordingly, it has long been desired to provide a way or means for providing a LOMA for engine cylinder valve deactivation which is simple, relatively low in manufacturing costs and easy to assemble on the engine.

BRIEF SUMMARY OF THE INVENTION

The present invention provides a Lifter Oil Manifold Assembly (LOMA) for use in deactivating the valves of selected cylinders in a multi-cylinder engine and employs solenoid operated valves disposed in valving chambers formed in a non-metallic valve mount/stiffener having sealing material on one side thereof for contacting a deckplate provided with an oil supply channel and individual outlet channels for, upon attachment of the deckplate to an engine block, communicating with the valve lifter/lash adjuster galleries for selected cylinders to be deactivated.

The non-metallic valve mount/stiffener has formed therein individual valving chambers, each ported to communicate with the supply channel on the deckplate and having an outlet port for communicating with a corresponding lifter control port on the deckplate. The valves are retained by a common retaining bracket received over the valves; and, a common lead frame electrically connects to the connector terminals on each of the electrically operated valves. The assembly is held together upon installation on an engine by fasteners such as through bolts threaded into the engine block.

DETAILED DESCRIPTION OF THE INVENTION

Figure 1:
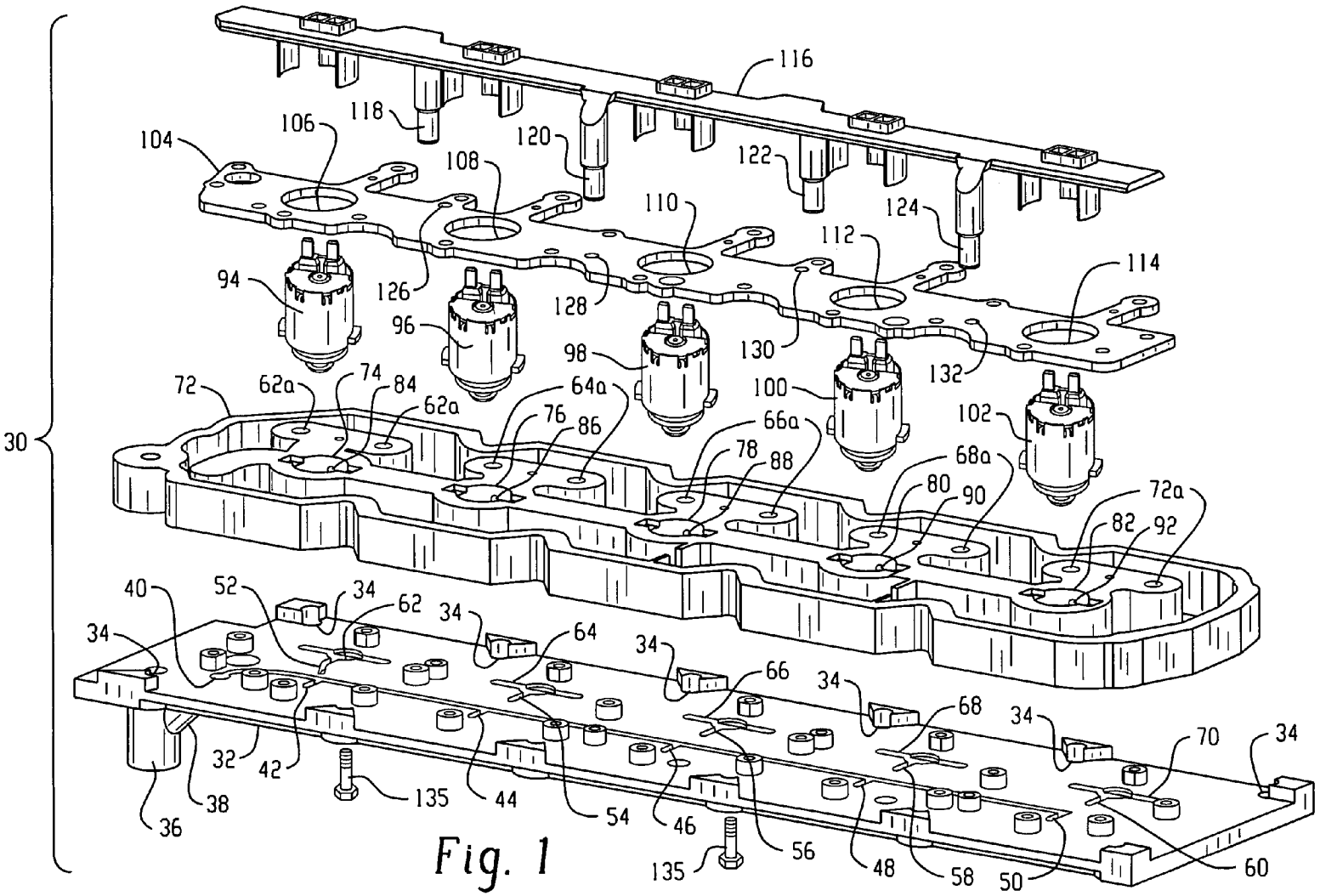
FIG. 1 is an exploded view of the Lifter Oil Manifold Assembly (LOMA) of the present invention.
Figure 2:
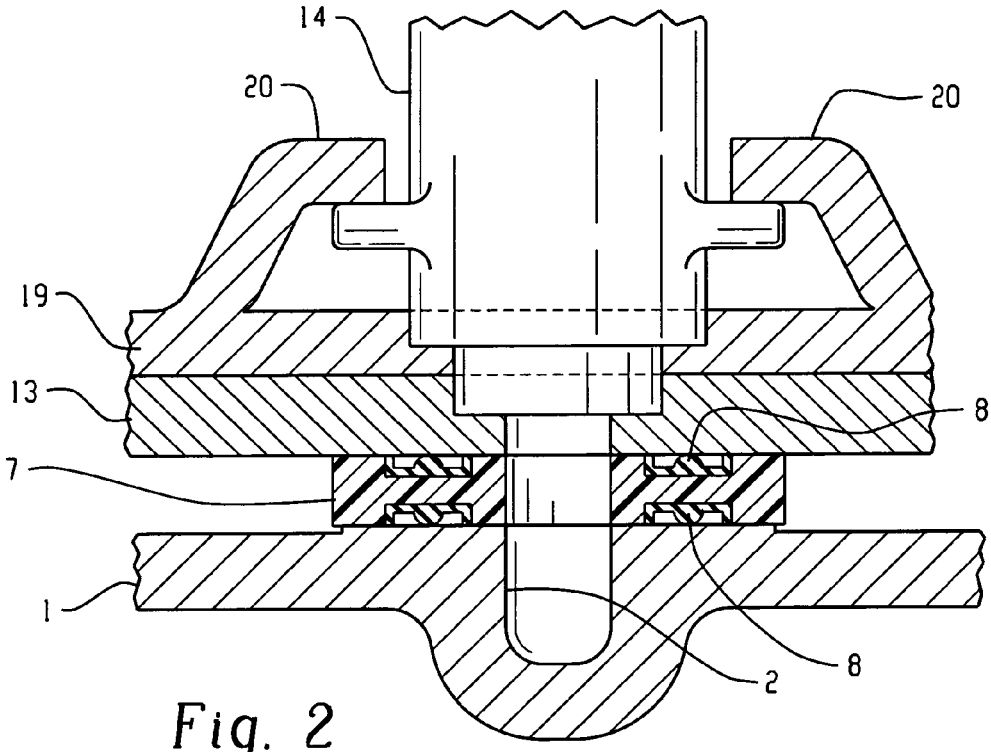
Fig. 2 PRIOR ART
FIG. 2 is a cross-section taken through one of the valves on the prior art assembly of FIG. 4.
Figure 3:
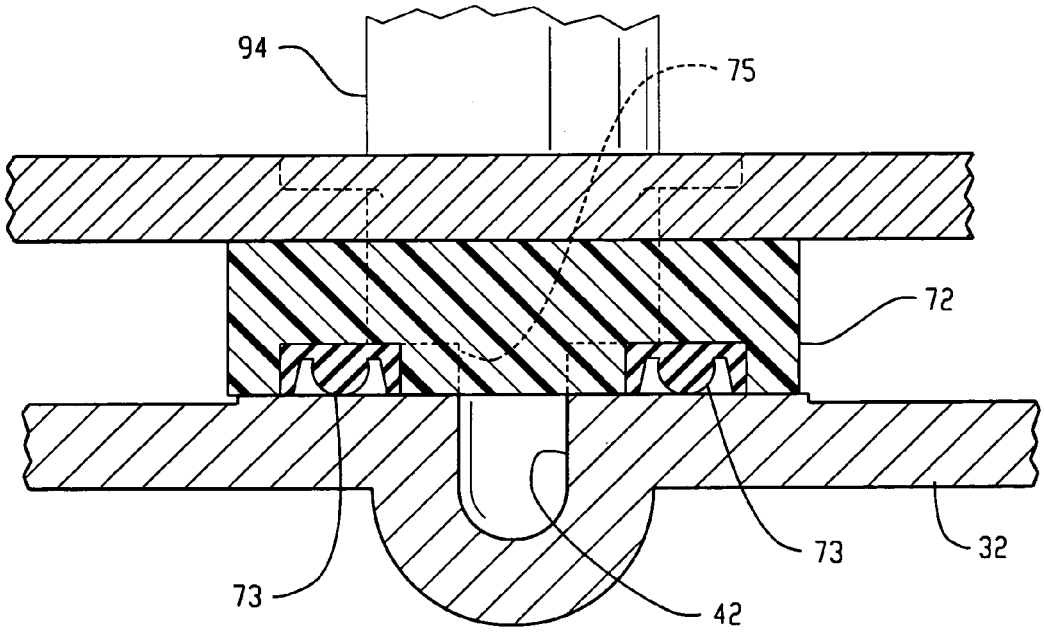
FIG. 3 is a cross-section taken through one of the valves in the assembled invention LOMA of FIG. 2; and, FIG. 4 is an exploded view of a prior art Lifter Oil Manifold Assembly.
Figure 4:
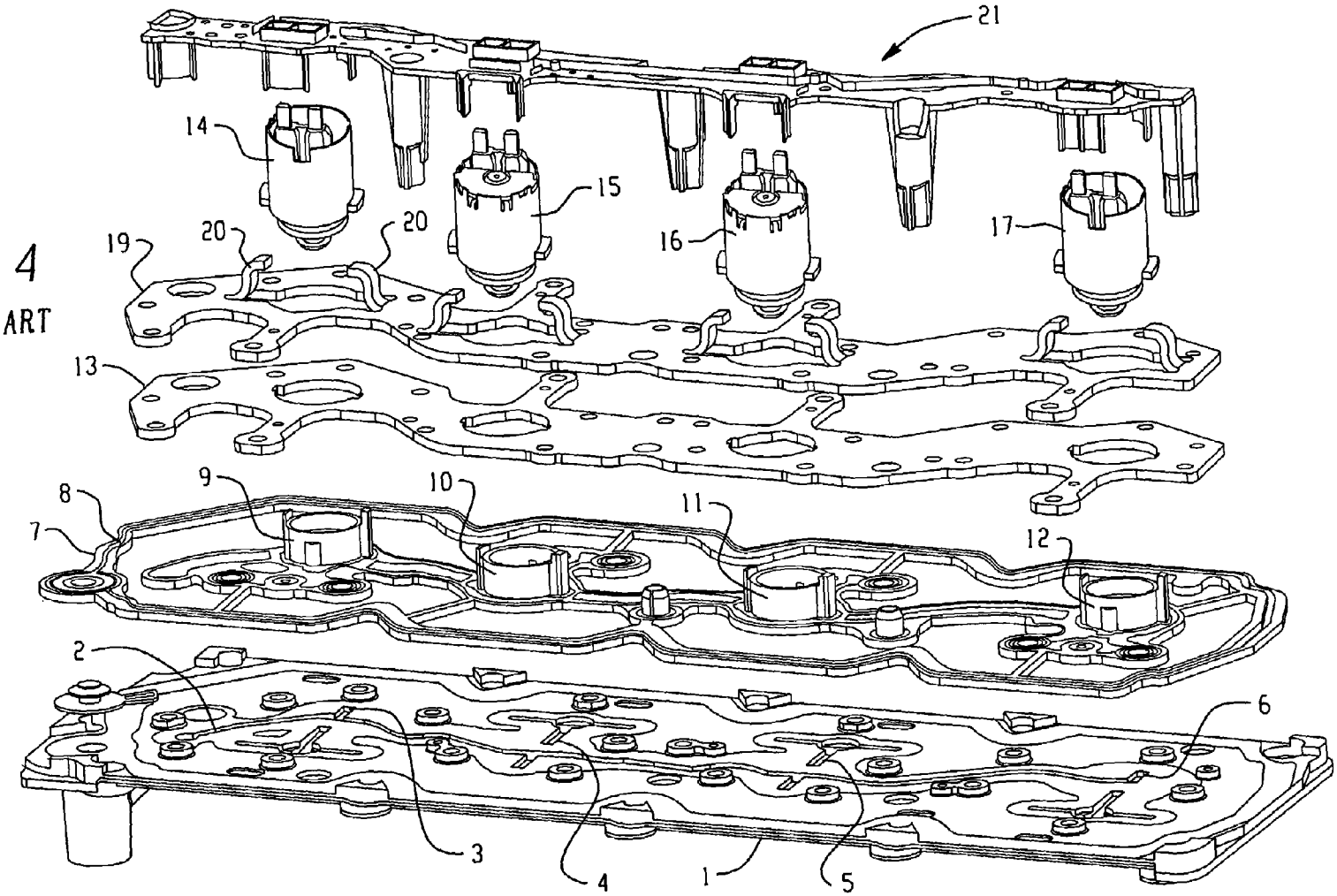
Fig. 4 PRIOR ART

Referring to FIGS. 1 and 3, an exemplary embodiment of the invention is indicated generally at 30 and includes a deckplate 32 adapted for attachment to an engine block through a plurality of mounting holes 34 and having a supply or inlet fitting 36 which has a conduit 38 ported thereto and which communicates with an inlet or pressure supply channel 40 formed along the upper surface of the deckplate 32. In the present practice of the invention the deckplate 32 is formed of metal, as for example, aluminum or other light metal.

Supply channel 40 has spaced therealong branches or side channels 42, 44, 46, 48, 50. Disposed adjacent each of the branches 42–50, is a corresponding control or outlet channel 52, 54, 56, 58, 60 respectively, each of which is in communication with an adjacent channel denoted respectively 62, 64, 66, 68, 70, formed in the surface of the deckplate.

A valve mount/stiffener member 72 is formed of non-metallic material such as, for example, polyamide material or polyamide partially filled with glass particles and generally conforms to and covers the deckplate 32. In the present practice, the valve mount/stiffener 72 is formed relatively thick with respect to its width, with the thickness thereof sufficient to provide the desired resistance to bending under the forces of the pressurized oil in the channels acting thereon.

Referring to FIG. 3, the valve mount/stiffener 72 has provided on the under surface thereof, preferably recessed in a groove, a resilient flexible seal 73 which is contoured and disposed about the various channels to provide sealing of the undersurface of the valve mount/stiffener 72 on the upper surface of deckplate 32. If desired, the seal 73 may be formed of elastomeric or other resilient material suitable for exposure to engine oil.

Referring to FIGS. 1 and 3, the valve mount/stiffener 72 has formed on the upper surface thereof a plurality of valving cavities denoted respectively at 74, 76, 78, 80, 82, each of which has an inlet passage therein which is ported to the undersurface of the valve mount/stiffener 72 for communicating with one of the respective supply channels 42–50, with one of the inlet passages shown in dashed outline in FIG. 3 and denoted by reference numeral 75. Each of the valving cavities 74–82 also has individually therein an outlet passage denoted respectively 84, 86, 88, 90, 92, which is ported to the undersurface of the valve mount/stiffener 72 for communicating with respectively one of the channels 52, 54, 56, 58, 60.

Each of the valving cavities 74–82 has received therein respectively an electrically operated valve such as solenoid valves 94, 96, 98, 100, 102 which are operable, upon electrical energization for controlling flow from the inlet channels respectively 42–50 to the outlet channels respectively 52–60.

The valve mount/stiffener 72 has a pair of through ports associated respectively with each of the valves; and, the through ports communicate with the outlet channels 62, 64, 66, 68, 70 respectively. The through ports are denoted respectively 62*a*, 64*a*, 66*a*, 68*a*, 70*a* and are positioned and located so as to communicate with corresponding lash adjuster/lifter gallery port risers (not shown) formed on the engine block. In this respect, it will be understood that the assembly 30 is shown inverted in FIG. 1.

A mounting bracket 104 has a plurality of apertures denoted respectively 106, 108, 110, 112, 114, each of which is received over one of the valves 94–102 in closely fitting arrangement for retaining the valve in its respective mounting cavity on the valve mount/stiffener 72. An electrical lead frame 116 is received over the valves and makes electrical connection with the terminals on each of the valves respectively. The lead frame includes standoffs or stanchions 118, 120, 122, 124 which extend downwardly therefrom with reference to FIG. 1 for contacting the upper surface of the bracket 104. The bracket has correspondingly located apertures therein such as apertures 126, 128, 130, 132 through which fasteners (not shown) may be received for retaining the lead frame on the bracket 104. It will be understood that the assembly 30 is retained on the engine block by fasteners such as through bolts (not shown) received through mounting holes 34, of which two are shown and denoted by reference numeral 135.

The present invention thus provides a simplified and relatively low cost, easy to manufacture, electro-hydraulic manifold assembly for controlling flow of engine oil to the valve lifters of selected cylinders for deactivating the valves to enable the engine to run on less than all the cylinders. The assembly of the present invention employs a non-metallic valve mount/stiffener which provides mounting cavities for the valves and provides the necessary rigidity for withstanding the pressure of the engine oil in the galleries acting thereagainst and thus minimizes the weight of the overall assembly by eliminating a separate stiffening plate.

Although the invention has hereinabove been described with respect to the illustrated embodiments, it will be understood that the invention is capable of modification and variation and is limited only by the following claims.

What is claimed is:

1. A manifold assembly for use in an engine combustion chamber valve deactivation system comprising:

(a) a deckplate having a supply channel and a plurality of control channels formed on a common surface thereof;

(b) valve mount/stiffener formed of non-metallic material with a plurality of valving recesses formed therein with each recess having an inlet and outlet port communicating with a common surface of said valve mount/stiffener, said common surface of said valve mount/stiffener disposed and sealed on said common surface of said deckplate with each of said outlet ports sealed about one of said control channel;

(c) an electrically operated valve disposed in each of said valving recesses;

(d) a retaining bracket received directly on said valve mount/stiffener and operable for retaining said valves in said valving recesses and said valve mount/stiffener on said deckplate; and, (e) fastening means operable for securing said bracket and valve mount/stiffener to said deckplate.

2. The assembly defined in claim 1, wherein said valving recesses have an orienting surface and each of said valves has a corresponding surface thereon engaging said orienting surface.

3. The assembly defined in claim 1, wherein said valve mount/stiffener is formed of material consisting essentially of polyamide material.

4. The assembly defined in claim 3, wherein said polyamide material is fractionally filled with particles of glass.

5. The assembly defined in claim 1, wherein said deckplate and said bracket are formed of metallic material.

6. The assembly defined in claim 1, wherein said valve mount/stiffener has flexible seals disposed on said common surface for sealing over said control channels.

7. The assembly defined in claim 6, wherein said flexible seals are formed of elastomeric material.

8. The assembly defined in claim 6, wherein said flexible seals are disposed in grooves formed in said common surface of said valve mount/stiffener.

9. The assembly defined in claim 1, further comprising a lead frame electrically connected to each of said valves.

10. The assembly defined in claim 9, wherein said lead frame is in plug-in connection with each of said valves.

11. A method of making a manifold assembly for use in engine combustion chamber valve de-activation comprising:

(a) providing a deckplate and forming a supply channel and a plurality of outlets on a common surface;

(b) forming a valve mount/stiffener of non-metallic material with a plurality of valving recesses each having an inlet and outlet communicating with a common surface of the valve mount/stiffener;

(c) disposing said common surface of said valve mount/stiffener on said common surface of said deckplate;

(d) disposing an electrically operated valve in each of the valving recesses; and, (e) securing a bracket directly on said valve mount/stiffener and retaining said valves thereon and retaining said valve mount/stiffener to said deckplate.

12. The method defined in claim 11, wherein said step of forming a valve mount/stiffener includes forming same of polyamide material.

13. The method defined in claim 11, wherein said step of forming a valve mount/stiffener includes filling said material partially with glass particles.

14. The method defined in claim 11, further comprising electrically connecting a lead frame to each of said valves.

15. The method defined in claim 11, wherein said step of disposing said common surface of said valve mount/stiffener includes sealing about each of said inlet and outlet ports with a flexible seal.

16. The method defined in claim 15, wherein said step of sealing includes sealing with an elastomeric seal.

* * * * *